United States Patent [19]

McCormick

[11] 4,313,987

[45] Feb. 2, 1982

[54] POLYSTYRENE VEHICLE BODY PROTECTOR SYSTEM

[76] Inventor: James L. McCormick, 467 W. Main St., Madison, Ohio 44057

[21] Appl. No.: 125,742

[22] Filed: Feb. 28, 1980

[51] Int. Cl.[3] ..... B32B 3/12; B32B 3/26; B32B 31/00

[52] U.S. Cl. ..... 428/40; 156/249; 156/265; 206/223; 428/159; 428/317.1

[58] Field of Search ..... 293/126; 296/31 P, 37.1, 296/95 C, 136; 280/770; 206/223; 428/40, 47, 315, 159, 343, 311, 352, 354, 31, 54–56, 77–79; 156/247, 249, 264, 265, 297; 410/4, 31, 43, 44, 121

[56] References Cited

U.S. PATENT DOCUMENTS

| | | | |
|---|---|---|---|
| 3,380,582 | 4/1968 | Moyer, Jr. et al. | 428/320 |
| 3,769,147 | 10/1973 | Komendat et al. | 156/249 |
| 3,869,332 | 3/1975 | Loew | 428/31 |
| 4,039,709 | 8/1977 | Newman | 428/354 |
| 4,061,820 | 12/1977 | Magid et al. | 428/315 |
| 4,083,095 | 4/1978 | Flaum et al. | 156/264 |
| 4,091,149 | 5/1978 | Oxendien | 428/315 |
| 4,139,099 | 2/1979 | Daly et al. | 428/40 |

*Primary Examiner*—William J. Van Balen
*Attorney, Agent, or Firm*—Keaty & Keaty

[57] ABSTRACT

The present invention relates to the packaging and/or protecting consumer products such as automobiles during shipping thereof with polystyrene panels.

25 Claims, 4 Drawing Figures

POLYSTYRENE VEHICLE BODY PROTECTOR SYSTEM

BACKGROUND OF THE INVENTION

1. Field of the Invention

The present invention relates to the packaging and/or protecting consumer products such as automobiles and the like during the shipping thereof. More particularly, the present invention provides a system of exterior protection for automobile exterior body surfaces and like critical impact areas subject to damage during shipment by impact from rocks, other vehicles, shipping transports and the like.

2. General Background and Prior Art

A problem facing the auto and vehicle industry is the shipment of vehicles, particularly automobiles and trucks, from the assembly plant or like manufacturing facility to the dealership or distributor for sale to the consumer.

Vehicles are often damaged on the exterior due to undesirable contact made by a foreign surface with the painted exterior surface of the vehicle or with the vehicle glass windows or mirrors. The result is a wasteful expense created by such damage which must be paid by the manufacturer or dealer and then passed to the consumer. The damage incurred can also be assessed in the terms of inconvenience to the consumer and time lost by the labor in touching up the damages incurred.

At present, styrofoam or foam blocks are used by some auto manufacturers placed on the front bumpers of the automobiles they manufacture. The foam block is secured with a length of nylon tape and a metal clamp to the bumper. Upon arrival at the dealership or final destination, and prior to sale, the styrofoam strip is severed using a cutting tool. The entire exterior body of a vehicle is presently unprotected from possible damage to the painted or glass surfaces. It is these exterior body surfaces and windows which are highly susceptible to damage during shipping. The particular automobile can be chipped or damaged simply by the opening of doors as it is sporadically occupied and driven on or off transport trucks, or into/out of various temporary warehouses or yards on its journey to the receiving dealer.

Vandalism unfortunately takes a high toll on vehicles as they are shipped. Most vehicle transports (whether by highway or rail) are relatively open structures, being an assembly of connected structural steel members with the vehicles readily accessible. For some reason, railroad cars holding vehicles are a particular "target" for vandals who throw rocks at the vehicle windows as the unmanned rail cars pass through various hostile environments often at relatively low speed and occasionally stopping. Rocks thrown in this manner can break windows, or strike the vehicle body causing dents, paint chipping and the like. It is to this problem that the present invention is directed.

GENERAL DESCRIPTION OF THE PRESENT INVENTION

The present invention provides a system for protecting the exterior surfaces of vehicles, with the application of a series of sculptured preshaped foam panels, depending upon the particular model of vehicle. The panels are designed to mold against preselected exposed surface and critical contact areas of the exterior surface of the vehicle in order to protect against damage done to the vehicle surface during shipping. In the preferred embodiment, each polystyrene panel would be of for example ½" to desired thickness in order to absorb the impact resulting from a foreign object making contact with the auto exterior surface occuring during shipping of the vehicle.

The polystyrene panels would be provided with an adhesive backing so that the panel could be easily adhered to that particular area of the exterior surface. In the preferred embodiment, each panel inner surface would be coated at least at critical points with the adhesive material. The adhesive material would be of such consistency so that it would adhere to the loosely bonded polystyrene surface permanently, yet bond to protective backing temporarily for shipment of the panels, and upon removal of said protective backing, to the exterior paint of the vehicle in such a fashion that the panel would securely adhere to the vehicle during shipment, but could be removed with little or no trace of residue on the paint of the vehicle, and without any damage whatsoever to the paint of the vehicle.

In the preferred embodiment, the adhesive material would be of a non-hydrocarbon base, water-base adhesive to insure permanent adhesion to the polystyrene panel, yet temporary adhesion to a provided protective backing as waxed paper, and temporary adhesion to the painted or glass window vehicle exterior surface as selected.

In the preferred embodiment of the invention, the molded panels would be precut with the use of a hot-saw means in such configurations to provide a series of precut panels in a "kit-type" arrangement to protect the critical areas of each particular style of vehicle to be protected. The panel kits, containing the necessary panels to protect a particular style of vehicle could be packaged for delivery. Ideally, the "kit" of panels would be available at the end of an assembly-line whereby the panels could easily be applied to the vehicle prior to being stored, shipped or even driven away from the assembly line. The precut or sculptured foam panels or sheets would thus correspond to and affix to a plurality of preselected exposed vehicle surface portions as windows, doors, etc.

It is an object of the invention to provide a system of protection for exterior exposed surface portions of vehicles during shipment.

It is another object of the invention to provide for a group of precut protective panels each sculptured to adhere to a preselected exposed vehicle surface area.

It is another object of the invention that the adhesive material be adapted with a protective backing so that the pre-cut panel may have adhesive material applied at time of manufacture so that the panels may be shipped in a "kit-type" fashion, each kit designed to fit the critical preselected exposed surfaces or impact points of a particular style of vehicle, yet during shipment would not adhere to one another.

It is another object of the present invention to provide foam panels having adhesive backing adhering to the foam surface yet temporarily to its protective backing and subsequently to the painted surface of the vehicle to be protected.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
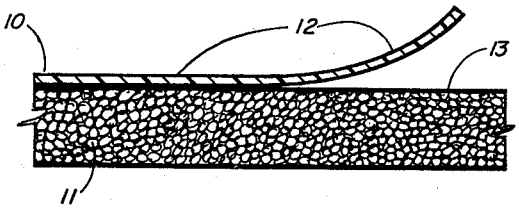
FIG. 1 is a cross-sectional view of the foam sheet portion of the preferred embodiment of the apparatus of the present invention.

FIG. 1 illustrates a cross-sectional view of the auto-vehicle protective panel 10. It should be noted that throughout the detailed description of the present invention, protective panel 10 is referred to as a representative panel. Since the design of the panel 10 depends upon the particular area of the vehicle to be protected and the particular style of vehicle; i.e., auto, truck, jeep, etc., it is the intent that the nomenclature referring to protective panel 10 shall be representative of the numerous panel 10 designs depending upon applicable use.

Protective panel 10 is in the preferred embodiment ½" to desired thickness uniform through its design. The protective panel 10 is constructed of polystyrene foam material, a hydrocarbon-base material which is of loose molecular construction, said construction represented by circular constructive bodies 11. FIG. 1 also illustrates the adhesive backing 12 as it is partially peeled away from the adhesive protective backing surface 13. As will be discussed more in detail when reference is made to FIG. 2, adhesive material 13 adheres permanently to polystyrene panel 10, yet temporarily to protective backing 12. Protective backing 12 would be adapted to the adhesive material 13 upon manufacture of polystyrene panel 10 immediately and in the preferred embodiment capable of being peeled away from the polystyrene panel 10 easily and quickly for immediate application of the panel 10 to the surface of the vehicle.

Figure 2:
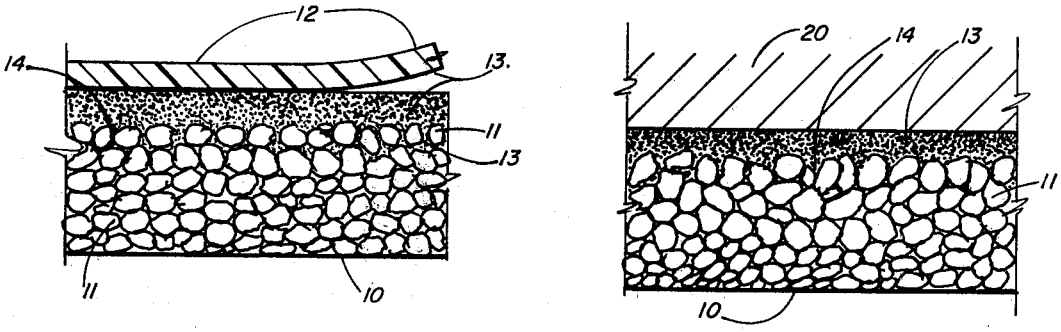
FIG. 2 is a macro-representation of the foam sheet and adhesive material backing and its relation to both vehicle and removable backing surfaces of the preferred embodiment of the apparatus of the present invention.

FIG. 2 is a microscopic representation of the material construction of the polystyrene panel 10, the molecular structure represented by circular bodies 11. Of particular importance is the fact that adhesive material 13 in microscopic representation of FIG. 2 is of such consistency that the adhesive material 13 is able to maintain permanent adhesion to polystyrene panel 10 due to the ability of the material 13 to seep into and adhere into the inter-body crevices 14 along the shallow surface area of polystyrene panel 10. However, as also represented in FIG. 2, the adhesive material 13 clings merely to the very top surface of protective backing 12, and upon removal of protective backing 12, to the surface of vehicle surface 20. Because in the preferred embodiment, the chemical makeup of the adhesive material 13 is a non-hydrocarbon, water-base substance, the adhesion to the hydrocarbon base, in most cases, lacquer surface 20 of the painted vehicle is on the very exterior surface 20, due to the fact that the hydrocarbon base lacquer paint is of extremely tight molecular configuration, not allowing any seepage and clinging of adhesive material 13 between the intermolecular spaces of the paint surface 20.

Figure 3:
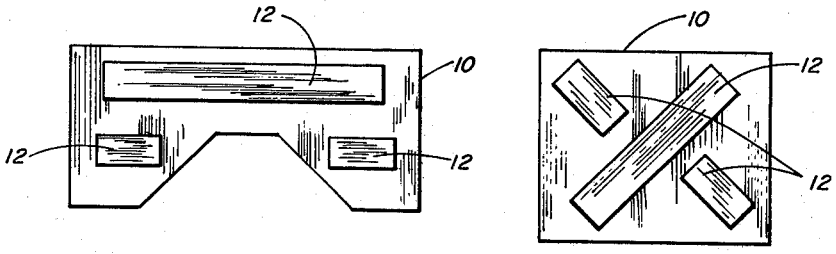
FIG. 3 is a frontal view of a representative panel of the preferred embodiment of the present invention.

To minimize the area of vehicle surface which would be exposed to the adhesive material 13, FIG. 3 illustrates the representative configuration which the adhesive material 13 should take to enable adequate adhesion to the vehicle surface 20, yet not establish unnecessary points of adhesion. Thus, FIG. 3 illustrates that the adhesive material 13 may, in the preferred embodiment, be arranged in strips 12 so that the panel will adhere to the surface 20 at the critical points to assure the panel adheres securely. The illustration in FIG. 3 represents the configuration as would relate to a particular panel 10, but in different configuration to differently designed panels.

Figure 4:
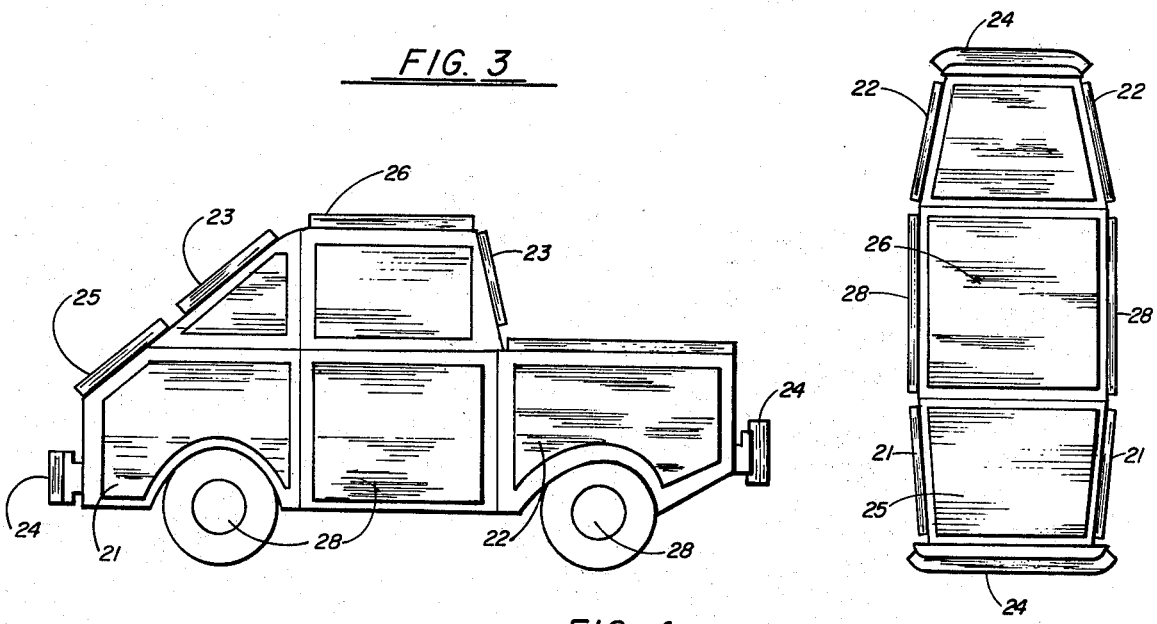
FIG. 4 is a schematic view illustrating application of the preferred embodiment of the apparatus of the present invention showing application of a vehicle body.

FIG. 4 is an illustration of the panels 13 as they would appear on a representative vehicle 20. The panels 13 would be adhered to the various critical impact areas following the peeling away of adhesive protective strip backing 12. Those critical impact areas represented by the following:

Rear quarter panels 21
Front fender panels 22
Door panels 28
Window panels 23
Trunk panel 25
Top panel 26
Wheel well panels 28
Bumper panels 24

In the preferred embodiment of the invention, it would be through the application of the above-numbered series of panels to a particular vehicle that the preferred application of the invention would be achieved.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A protective automobile shipping apparatus comprising:

a. a sheet of foam material having an interior and exterior surface, each terminating at a common edge portion;

b. an adhesive layer formed on at least a portion of said interior surface, said adhesive layer adhering into the inter-body crevices along the shallow surface area at said critical points along said sheet of foam material;

c. temporary peel-off non-adhering backing means removably affixed to said adhesive layer and covering said foam sheet interior surface; and d. cutting means for precutting said sheet of foam material to a desired sculptured shape.

2. The apparatus of claim 1 wherein said foam material is expanded bead polystyrene.

3. The apparatus of claim 1 wherein said cutting means is a heated member.

4. The apparatus of claim 3 wherein said heated member is a hot wire knife.

5. The apparatus of claim 1 wherein said adhesive layer is a non-hydrocarbon base adhesive layer.

6. The apparatus of claim 1 wherein said adhesive layer is a water-base adhesive layer.

7. The apparatus of claim 1 wherein there are a plurality of said sheets of foam materials, each being precut to conform to a desired preselected exposed vehicle surface portion.

8. The apparatus of claim 1 wherein said foam sheet has a density of between one and ten pounds per cubic foot.

9. The apparatus of claim 1 wherein said foam sheet is polystyrene foam.

10. A method of protectively packaging automobilies for shipment comprising the steps of:

a. selecting a number of exposed vehicle surface portions to be protected;

b. providing a sheet of foam material for each preselected exposed vehicle surface portion;

c. sculpturing each sheet of foam material to generally fit its corresponding preselected exposed vehicle surface portion;

d. applying an adhesion means onto selected critical portions of said sheet of foam material, said adhesion means adhering into the inter body crevices along the shallow surface area of said sheet of foam material;

e. adhering each sculptured panel to its corresponding preselected exposed vehicle surface portion, said sculptured panel adhering to said exposed vehicle surface at those sections of the sculptured panel wherein the adhesion means has been applied.

11. The method of claim 10 further comprising the step of applying an adhesive backing to each sheet of foam material prior to its application to the desired exposed vehicle surface portion.

12. The method of claim 10 further comprising the step of applying a non-hydrocarbon-base adhesive backing to each sheet of foam material prior to its application to the desired exposed vehicle surface portion.

13. The method of claim 10 further comprising the step of applying a water-base adhesive backing to each sheet of foam material prior to its application to the desired exposed vehicle surface portion.

14. The method of claim 10 wherein in step "a" the selected exposed vehicle surface portions include at least in part some of the vehicle windows.

15. The method of claim 10 wherein in step "b", the provided sheets of foam material have a density of from one to ten pounds per cubic foot.

16. The method of claim 10 wherein in step "b" the provided sheets of foam material are polystyrene foam.

17. A foam panel vehicle body protector system comprising:

a. a series of polystyrene foam panels each sculptured to fit various areas of the exterior surface;

b. adhesive backing means formed on at least a portion of said interior surface for adhering each of said foam panels to preselected exposed portions of the vehicle body;

c. a protective layer secured temporarily to the adhesive means of the aid polystyrene panels which can be easily removed so that the panel may be secured to the exterior surface of a vehicle.

18. The adhesive means in claim 17 wherein the adhesive material is of non-hydrocarbon base, and of such consistency to seep into and adhere to the loose molecular body structure of said polystyrene panel material.

19. The adhesive means in claim 1, wherein the adhesive material is of non-hydrocarbon base and adheres temporarily to the protective layer and hydrocarbon-base lacquer-type paint finish of said vehicle.

20. The polystyrene panels in claim 1, wherein the panels would be so sculptured to mirror in design the vehicle top panel, trunk panel, front fender panels, door panels, window panels, wheel-well panels rear quarter panels and bumper panels.

21. A method of protecting the exterior of a vehicle during shipment comprising:

a. pre-cutting a series of polystyrene panels to mirror in design the critical impact areas of a vehicle exterior;

b. adapting said polystyrene panels with areas of adhesive material so that the panel may be adhered to the vehicle during shipment;

c. adapting said adhesive material with a protective backing so that the panels may be stored in a series and not adhere to one another during shipment.

22. The method of claim 1, wherein the panels are precut with the use of a hot saw to mirror the vehicle top panel, trunk panel, front fender panels, door panels, window panels, wheel well panels, rear quarter panels and bumper panels.

23. The method of claim 5, wherein the adhesive material adapted to said panel is of such consistency so as to adhere permanently to the intermolecular spaces of said polystyrene panel.

24. The method of claim 6, wherein the adhesive material of said panel is of such consistency to adhere temporarily to the protective strip and surface of said vehicle.

25. The method of claim 6, wherein the adhesive material is adhered to the polystyrene panel in selected areas of the panels for firm adhesion to the vehicle exterior surface.

* * * * *